US008805639B1

(12) United States Patent
Musicant et al.

(10) Patent No.: US 8,805,639 B1
(45) Date of Patent: Aug. 12, 2014

(54) IDLE DETECTION FOR IMPROVING FUEL CONSUMPTION EFFICIENCY IN A VEHICLE

(75) Inventors: Oren Musicant, Tel Aviv (IL); Yaakov Hayun, Zoran (IL); Ofer Nissim Raz, Tel Aviv (IL)

(73) Assignee: Greenroad Driving Technologies Ltd., Beit Dagan (IL)

( * ) Notice: Subject to any disclaimer, the term of this patent is extended or adjusted under 35 U.S.C. 154(b) by 257 days.

(21) Appl. No.: 13/071,389

(22) Filed: Mar. 24, 2011

(51) Int. Cl.
*G09F 15/00* (2006.01)

(52) U.S. Cl.
USPC ..... 702/127; 702/1; 702/141; 702/142; 702/189

(58) Field of Classification Search
CPC ..... B60W 2510/00; B60W 2510/0642; B60W 2710/00; B60W 2710/065; B60W 30/18054
USPC ..... 702/33
See application file for complete search history.

(56) References Cited

U.S. PATENT DOCUMENTS

| | | | | |
|---|---|---|---|---|
| 5,619,412 | A * | 4/1997 | Hapka | 701/36 |
| 2011/0166773 | A1* | 7/2011 | Raz et al. | 701/123 |
| 2011/0205044 | A1* | 8/2011 | Enomoto et al. | 340/439 |
| 2011/0288743 | A1* | 11/2011 | Smith | 701/102 |

* cited by examiner

*Primary Examiner* — Mischita Henson
(74) *Attorney, Agent, or Firm* — Dekel Patent Ltd.; David Klein

(57) ABSTRACT

A data processing system which comprises: a first sensor adapted to provide indications of a first type on a vehicle's engine operational mode; a second sensor adapted to provide indications of a second type related to the vehicle movement; and a processor adapted to identify one or more vehicle idling periods, based on at least one indication of the first type and at least one indication of the second type.

21 Claims, 5 Drawing Sheets

IDLE DETECTION FOR IMPROVING FUEL CONSUMPTION EFFICIENCY IN A VEHICLE

TECHNICAL FIELD

The present disclosure generally relates to monitoring the operation of vehicles, and more particularly to techniques for improving the vehicle's fuel consumption.

BACKGROUND

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

Fuel cost constitutes a significant part of the vehicle owner's daily expenses, and is even more significant when it comes to vehicle fleets. For many of today's vehicle fleets, fuel consumption due to unnecessary vehicle idling (i.e., keeping the engine running while the vehicle remains stationary for an extended period of time) represents a significant portion of the overall fleet fuel costs as well as vehicles' undesired emissions. Unnecessary idling often represents about 5% or more of the overall fuel consumption, therefore minimizing the unnecessary idling entails a big impact upon fleet cost savings and emissions' reductions.

In addition to the fuel consumption factor discussed above, excessive idling might create other problems. First, an idling engine does not operate at its peak temperature, and consequently fuel combustion is incomplete. As a result, fuel residues might condense on the cylinder walls, contaminate the oil and damage engine components. For example, such residues tend to deposit on spark plugs, thus, the more engine idling events occur, the higher is the drop in the average plug temperature and accelerated scaling aggregation on the plugs. This phenomenon might increase fuel consumption by 4 to 5 percent. Excessive idling can also cause water to condense in the vehicle's exhaust, which in turn can lead to corrosion and reduce the length of the exhaust system life.

A vehicle is considered to be idling anytime when the engine is running while the vehicle is stationary. However, not all of these idling periods are considered to be unnecessary. Short duration idling periods e.g. at traffic lights, stop signs, etc., are typically viewed as being situations in which idling is unavoidable or not significant enough from a fuel saving perspective, to target them for elimination, while longer idling periods are found typically to be unnecessary idling periods.

SUMMARY OF THE DISCLOSURE

The disclosure may be summarized by referring to the appended claims.

In an embodiment, improving the vehicle's fuel consumption is achieved by identifying a plurality of unnecessary idling periods associated with a vehicle and/or unnecessary idling periods attributed to a certain driver.

In an embodiment, visibility of information about unnecessary idling is provided to drivers and managers, which in turn allows drivers to self-correct their behaviour and to essentially eliminate unnecessary idling periods.

In an embodiment, consistent idling performance assessments are provided across various vehicle types.

In an embodiment, various approaches enable customizing the system, in order to address specific operating environments and needs within users' vehicle fleets.

In an embodiment, approaches are provided to automatically collect and analyze all idling information, and to provide feedback based on the idling information retrieved via a secured web portal.

In an embodiment a system is configured for identifying a plurality of unnecessary idling periods associated with a vehicle and/or attributed to a certain driver, comprising:

- a first sensor adapted to provide indications of a first type on the vehicle's engine operational mode. This first sensor may be a probe obtaining information to enable providing the first indication either from the engine computer module (ECM), or directly from the ignition switch, or from measuring the vehicle voltage output, or from other methods;
- a second sensor adapted to provide indications of a second type related to the vehicle movement. This second sensor may be a probe obtaining information to enable providing the second indication either from the engine computer module (ECM), or from a GPS reading, or from an accelerometer or a connection to the VSS (Vehicle Speed Sensor) sensor of the car, or other methods;
- a processor adapted to identify the plurality of unnecessary idling periods, based on at least one indication of said first type and at least one indication of the second type.

In an embodiment the first sensor is operative to retrieve the vehicle's battery voltage output and to detect therefrom changes in the vehicle's operational status.

According to yet another embodiment of the present invention, the first sensor is adapted to detect one or more voltage signatures or patterns in the vehicle's battery voltage output. Each of the voltage signatures is associated with an operational mode of the vehicle's engine.

According to still another embodiment, the first sensor is further adapted to compensate for variations in the detected patterns in various types of vehicles. Consequently, the system provided may be implemented in all types of vehicles.

In accordance with another embodiment the second sensor is configured to obtain acceleration data which relate to the vehicle's movement, and the processor is configured to detect a change in the vehicle's operational status based on one or more acceleration changes which the vehicle has undergone.

In an embodiment, the processor is further adapted to classify identified unnecessary idling periods based upon driving sessions which took place before or after the identified unnecessary idling periods.

According to another embodiment, the system further comprises a transmitter adapted to transmit the first indication and the second indication toward a remote server, and the remote server comprising the processor is adapted to identify the more than one unnecessary idling periods. The remote server preferably has a database where the information regarding the unnecessary idling periods is stored, and thus the remote server enables analyzing the changes in the idling habits of a driver and/or of a plurality of drivers.

In another embodiment, the system further comprises a displaying means to enable providing the driver indications which relate to his/her idling related performance, which in turn may be used as a tool to assist in changing the driver's performance in that respect, if necessary.

In an embodiment, a method is provided for identifying a plurality of unnecessary idling periods associated with a vehicle and/or attributed to a certain driver, comprising:

providing a threshold parameter for distinguishing between a necessary idling period and an unnecessary idling period;

retrieving information regarding the vehicle's engine operational mode and movement of the vehicle; and analyzing the retrieved information and identifying based on the threshold parameter the plurality of unnecessary idling periods. This step may be executed at a processor within the vehicle or at a remote server where the information is stored.

In an embodiment, the information regarding the vehicle's engine operational mode is obtained by detecting or measuring the vehicle's battery voltage output. In the alternative or in addition, the information regarding the vehicle's engine operational mode comprises information retrieved from measuring relatively small voltage changes caused by the alternator which generates alternating voltage.

In an embodiment, the method further comprises detecting one or more voltage signatures or patterns in the vehicle's battery voltage output, and each signature or pattern is associated with a vehicle's engine operational mode. Different signatures or patterns may indicate different vehicle engine operational modes.

In an embodiment, the method further comprises classifying identified unnecessary idling periods based upon driving sessions which took place before or after the identified unnecessary idling periods.

In another embodiment, the method further comprises calculating changes in the vehicle's acceleration, and applying one or more of the calculated acceleration changes for detecting a change in the vehicle's operational status.

In an embodiment, the method further comprises transmitting the first indication and the second indication towards a server computer, to enable identifying unnecessary idling periods at the server computer.

According to another embodiment there is provided a non-transitory computer-readable storage media storing one or more sequences of instructions which when executed cause one or more processors to perform:

detecting a change in an operational mode of a motor vehicle based on one or more first input signals from a first sensor;

detecting a change in movement of the motor vehicle based on one or more second input signals from a second sensor;

identifying one or more idling periods in which the motor vehicle is idling, based on the first input signals and the second input signals;

storing data representing the one or more idling periods.

BRIEF DESCRIPTION OF THE DRAWINGS

For a more complete understanding of the present invention, reference is made to the following detailed description taken in conjunction with the accompanying drawings wherein.

DETAILED DESCRIPTION

In this disclosure, the term "comprising" is intended to have an open-ended meaning so that when a first element is stated as comprising a second element, the first element may also include one or more other elements that are not necessarily identified or described herein, or recited in the claims.

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

Figure 1:
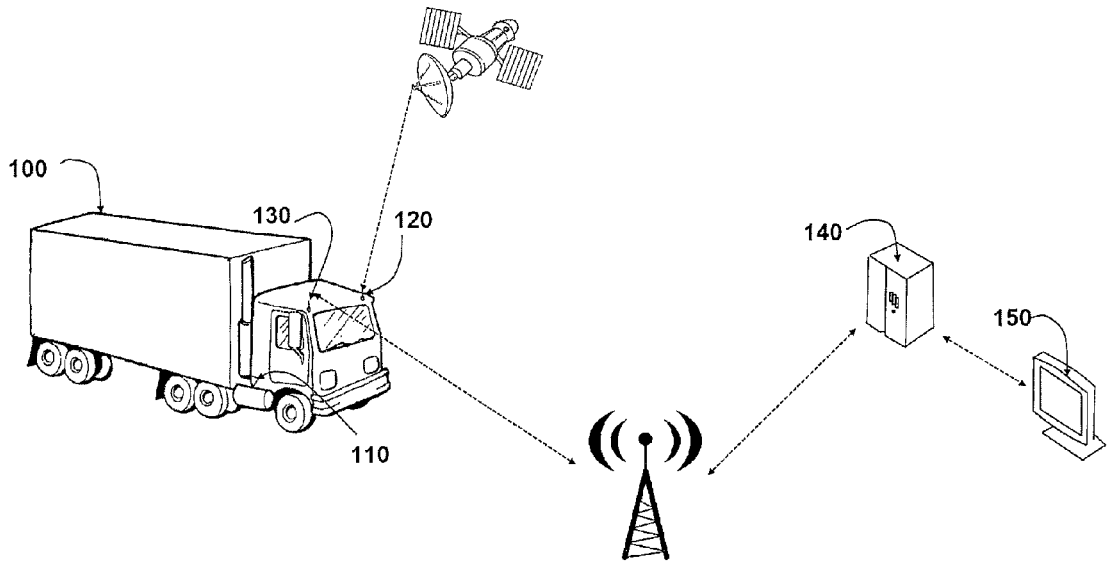
FIG. 1 illustrates a schematic overview of an example of the system architecture.

FIG. 1 illustrates an example of a system that comprises a first sensor adapted to provide indications of a first type which relate to the vehicle's engine operational mode. FIG. 6A further illustrates functional units of an example idle time detection unit that may be used in an embodiment. In this example, the first sensor is the vehicle voltage sensing (VVS) device (110), which is connected to a power supply 102 of the vehicle (100). The VVS 110 device may detect one or more voltage signature patterns in the vehicle's voltage output, which may indicate the vehicle's engine operational mode.

The vehicle 100 may also comprise a second sensor, e.g. a GPS receiver (120), adapted to provide indications of a second type to enable determining whether the vehicle is moving or not. In the alternative or in addition, indication(s) of the second type are provided by one or more accelerometers which measure acceleration differences over the respective one or more axis by sampling the acceleration at a predetermined frequency e.g. 50 Hz or 75 Hz. Furthermore, by this example, the vehicle 100 further comprises a transmitter (130), which is adapted to transmit to a server computer (140) information that relates to indications of the first type (e.g. the ignition status from the VVS device) and information derived from the indications of the second type.

The information received from the vehicle's transmitter (130) is analyzed (and optionally stored) at the server computer, and based on that analysis, unnecessary idling periods are identified. The information regarding the identified unnecessary idling periods is conveyed to the fleet manager/driver own personal computer (150), possibly via the internet.

Alternatively or in addition, the information may be analyzed by a processor located in the vehicle and adapted to process received data in the process of identifying unnecessary idling periods. For example, referring now to FIG. 6A, an idle time detection unit 602 may comprise VVS 110 coupled to power supply 102 and to processor 604, which is further coupled to GPS receiver 120 having a first antenna and transmitter 130 having a second antenna. Processor 604 is further coupled to storage 608 and idling period identifying logic 606, which may comprise one or more elements of hardware logic such as ASICs or FPGAs, or volatile or non-volatile memory storing instructions that the processor may load and execute. Idling period identifying logic 606 may be configured to implement the processes that are described herein when the logic is invoked or executed by processor 604.

In an embodiment three types of parameters are used to detect unnecessary idling:

Vehicle engine status (first type indications)—This parameter indicates whether the engine is running, or not. This is typically determined by detecting the ignition status or changes in the ignition status. Optionally, a vehicle voltage level sensing approach (which is further explained below) is applied. Other approaches may be used as further described herein.

Vehicle motion or speed (second type indications)—This parameter may be determined by any applicable sensor which is indicative of the vehicle movement e.g. as provided by the Engine Computer Module (ECM), or may be derived from GPS readings of the vehicle's location or from data derived from one or more accelerometers. In one embodiment, the parameter may be obtained from a GPS receiver in the vehicle that internally calculates vehicle speed based on spatial movement.

Minimum idling threshold setting—This parameter may be determined by a customer or other vehicle owner or operator (e.g. a fleet manager) or by the manufacturer, and may be applied either at any time prior to the driving session being analyzed, or applied on the results obtained from the above-mentioned sensors.

Whenever the ignition status indicates that the engine is running and the vehicle motion or speed parameter for the vehicle indicate that the vehicle is not moving, the system may start recording an idling period. If the time period starting from the time when the vehicle stopped moving exceeds the minimum idling period threshold, then the full duration of the idling period may be captured. The idling period may be determined as ended either when the parameter values indicate that the engine is turned off or that the vehicle is moving. Further explanations on the different types of idling periods will be provided hereinafter.

Monitoring the Vehicle Voltage Level

In an embodiment, a process enable implementing the vehicle voltage level sensing approach for use in monitoring idling periods across multiple types of vehicles. The process may be implemented without the need to use additional hardware components and without adding the costs of a telematics device to the installation cost.

Figure 6B:
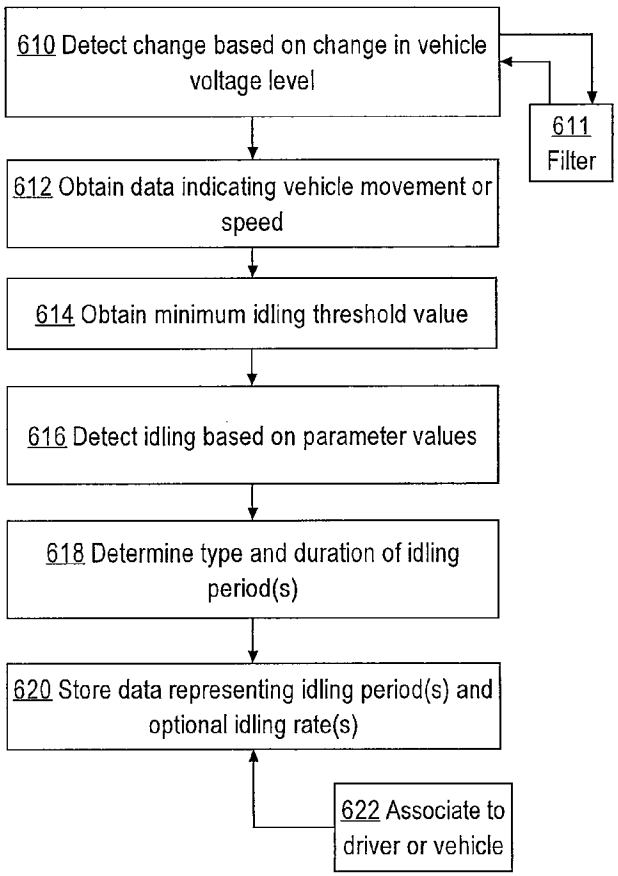
FIG. 6B illustrates a process of idle detection.
Figure 6A:
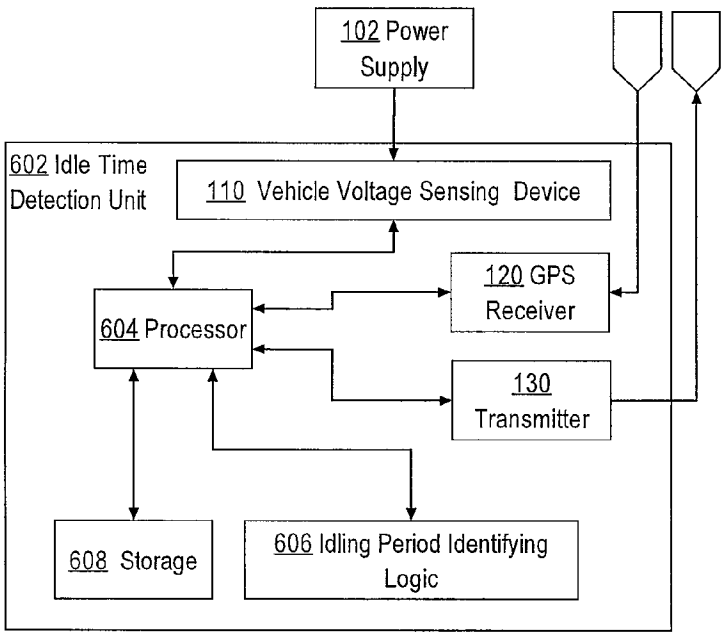
FIG. 6A illustrates an example idle time detection unit.

FIG. 6B illustrates an example process of idle detection. As an overview, in step 610, the process detects a change in ignition status of the vehicle based on a change in vehicle voltage level. Optionally, data representing the detected voltage level may be subject to filtering as indicated by filter 111 and as further described below.

In step 612, data is obtained indicating the movement or speed of the vehicle. In step 614, a minimum idling threshold value is obtained for purposes of determining whether the data from steps 610, 612 actually represents an idling event.

In step 616, an idling event is detected based on the previously obtained parameter values. Particular ways of detecting idling events are described further herein.

In step 618, the process determines the type and duration of one or more idling events based on the previously obtained data. Particular types of idling events, and how to determine a duration or classification of idling events, is described further herein.

In step 620, one or more items of data representing idling periods, and optionally including idling rates, or various vehicle parameters, are stored. Also optionally, the stored data representing idling periods may be associated with data identifying a driver or vehicle.

The preceding description of FIG. 6B provides an overview of an embodiment of a process of detecting an idling period of a motor vehicle based on changes in vehicle voltage levels. Alternatively, ignition events may be detected directly from the ignition switch using techniques described herein. Further, additional details for embodiments of the foregoing steps are now provided.

In an embodiment based on ignition detection, current voltage levels of a vehicle's engine are measured and analyzed to enable determining the ignition status and/or to enable detecting changes in the ignition status. The process assumes that there are characteristic signatures or patterns of voltage level variation when a vehicle's engine is on, off, and while switching between on and off modes, and is adapted to detect such voltage signature patterns.

In an embodiment, the process may compensate for variations in the detected patterns across different vehicle types and their physical condition and individual vehicles. For example, old vehicles and/or an old battery may cause the voltage pattern to vary as compared to new ones. Embodiments may compensate for pattern variations over time occurring in individual vehicles.

Figure 2A:
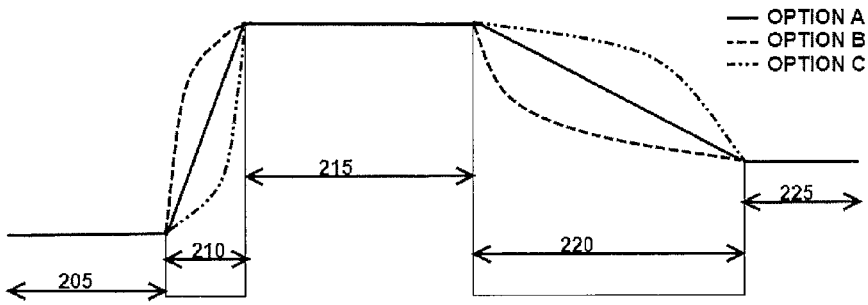
FIG. 2A presents a voltage level variation pattern as a function of time.

FIG. 2A provides a voltage level variation pattern. FIG. 2A illustrates three options to demonstrate that while vehicle may have a different voltage pattern, the difference in patterns does not influence the process, which takes into account the difference in the voltage.

The voltage level variation pattern in FIG. 2A consists of five sections (205,210,215,220 and 225), each section representing a different status of the engine. Before ignition the voltage level is at a constant standing voltage (section 205), then when the engine is turned on, there is a significant increase in the voltage over a certain period of time (section 210).

Thereafter, the voltage remains relatively constant at a high value(section 215) until the engine is turned off (section 220), at which point the voltage drops over a certain period of time to a somewhat higher level than that of the standing voltage (section 225) before returning to the long-term engine off level. This latter transition is not shown in this FIG. 2A.

Figure 2B:
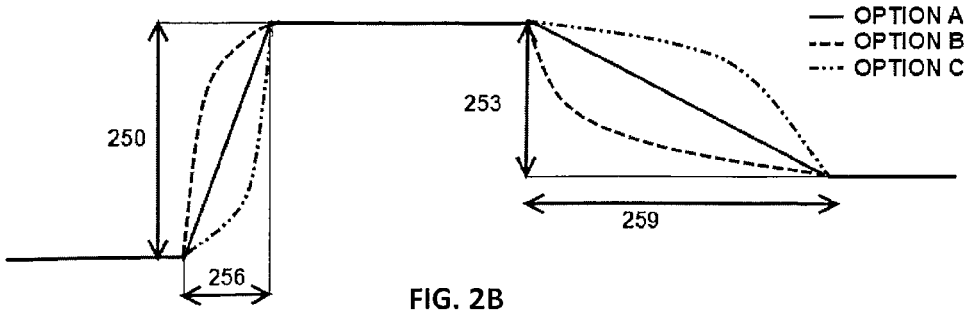
FIG. 2B demonstrates algorithm parameters of the voltage level variation pattern shown in FIG. 2A.

In an embodiment, voltage variation signature parameters enable high flexibility in modelling and compensating for behaviours of different vehicles, different batteries, and various operating conditions. Example parameters are demonstrated in FIG. 2B, in which the vertical axis illustrates voltage differences and the horizontal axis indicates time. Example initial default values are shown in Table 1.

TABLE 1

| Parameter name | Reference numbers | Initial default value |
|---|---|---|
| IGNITION_ON_DELTA _V | 250 | 0.7 V |
| IGNITION_OFF_DELTA _V | 253 | 0.7 V |
| IGNITION_ON_DELTA _T | 256 | 1 sec |
| IGNITION_OFF_DELTA _T | 259 | 1 sec |
| No. of sampling points for IGNITION_ON event | | 24 |
| No. of sampling points for IGNITION_OFF event | | 180 |

In an embodiment, when an ignition state change is detected (either when the engine is turned on or turned off), one or more of the following data may be captured and analysed or sent to the server computer: the ignition status (e.g. whether the engine is turned on or turned off), the timestamp (e.g. when was the ignition status changed), the location (e.g. GPS information which relates to the location at which the ignition status was changed), and the voltage level at the time when the ignition status was changed.

In an embodiment, the voltage level sensing approach may also be used to enable detection of degradation in battery voltage performance. For example, if the battery is sufficiently drained, the voltage level variation signature may deviate from its normal signature, and/or there could be fluctuations in the voltage level when the engine is on. In an embodiment, such variations and fluctuations may be detected and responsive messages may be provided to the driver or to an operator of the server computer. A recommendation for replacing the battery should preferably not be automatically provided to the driver when such a situation is detected, because there could be other reasons for voltage levels degradation or that the voltage behaves aberrantly, for example: when the battery charging system or the vehicle's alternator is not working properly, loss of battery acid, etc.

It could happen that occasional false positive ignition on events are detected. Such false events are most commonly generated in the following situations:

1. After a unit implementing the system architecture of FIG. 1 goes to sleep (a process that is demonstrated by the following steps:
   a. The driver turns the engine off -> the unit sends "ignition off" message.
   b. After a pre-determined number of minutes, the driving session ends -> the unit sends an end of session (MNV2) message
   c. After a few more seconds the unit enters sleep mode.
   d. A false "ignition on" message is generated.
2. When the unit is in sleep mode and reconnects with the server. For example, a unit may be configured to wake up every 4.5 hours. Although the engine is off the vehicle voltage pattern may continue to change because some devices coupled to the vehicle electrical system may continue to consume power. For example, the vehicle may have an alarm system. In this environment, reconnection may result in generating a false "ignition on" message because the unit detects a draw on vehicle voltage.

Therefore, in an embodiment, to avoid creating information falsely indicating a long idling event, starting with a false ignition-on event and ending when the vehicle starts moving, a filtering operation may be provided. In one embodiment, a filtering processor calculates the average vehicle voltage during an ignition-on event (for example, the voltage reported in the ignition-on command) and takes into consideration real ignition-on events(for example, events that are known to be non-false events) at previous times, which are used as a reference, while not using false ignition-on events in the calculation. The calculated average vehicle voltage level during an ignition-on event is stored in memory. In the context of FIG. 6B, filter 111 represents filter processing.

Then, for every new ignition-on event, the filtering processor compares the present voltage level with the average level, and if the present voltage level is less than the average by a specified constant then the event is determined to be a false ignition-on. The false ignition on event may be marked in the database as a false ignition-on, to ensure that it is not used in the future for the average calculation. The specified constant may be a configurable parameter value, e.g. a starting value may be 0.25V or 0.5V).If the voltage level is higher than the average voltage level less the constant, then the event is a real ignition on event. Optionally, the filtering processor is an integral part of the first sensor.

Monitoring the Vehicle Movement

As aforesaid the second indication may be obtained from a GPS receiver in the vehicle, and/or from one or more accelerometers (e.g. to obtain 3 dimensional samples), and/or by any other applicable sensor which is capable of providing indications of the vehicle movement. The following process serves as a non limiting example for using second indication type of data in order to detect one or more changes in the vehicle's operational status. By this example, the differences in the vehicle position is measured over the 3 axis, namely, ΔX, ΔY, ΔZ (e.g. using samples obtained from measurements taken at a frequency in the range of 10 Hz to 200 Hz). The vehicle acceleration gradient (ΔD) is then calculated, and the moving average (MA) and the moving standard deviation (SD) are derived therefrom.

The vehicle acceleration gradient is defined as:

$$\Delta D=(\Delta X^2+\Delta Y^2+_{\Delta Z}{}^2)^{0.5}.$$

According to this example, the ON/OFF index is calculated for each sample by applying the following:

$$\text{ON/OFF_index}=\frac{MU+3.06}{\sqrt{\text{Sigma}\hat{}2/50+4.4*10^{-4}}}$$

In the present example, the MU was converted to Lognormal. In case that the status was defined as "OFF" (based on the information derived from the first indication) and the ON/OFF_index is now found to be greater than 10, the status will be changed to "ON", whereas, in case the status was defined as "ON" (based on information derived from the first indication) and the ON/OFF_index is found to be less than 0, the status will be changed to "OFF".

Calculating the Idling Periods

In an embodiment, the calculation of idling periods may be performed on data from a pre-defined time frame which occurred in the past.

In the following description, the term "driving session" includes the duration of time at which a vehicle is in motion, from the first motion detected till the vehicle is motionless for a continuous period of X minutes. However, if, during the driving session, the vehicle did not move during one or more periods, each extending for less than X minutes, these one or more periods will all be included in that driving session. For example, idling while stopping at traffic lights is included in the driving session. Once the vehicle did not move for X or more minutes, this motionless period will not be included within the same driving session, and a new driving session will start thereafter (when the vehicle starts moving once again).

The term "idling period" as used herein is defined as the duration of time at which a vehicle's engine is running while the vehicle is not moving, as long as that period is longer than a pre-defined value (e.g. Y minutes).

Figure 3:
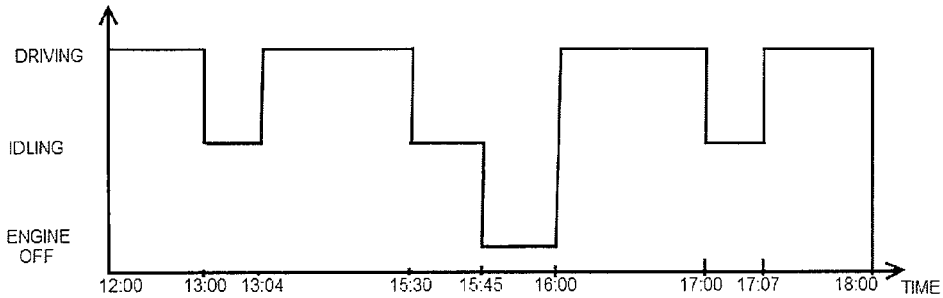
FIG. 3 demonstrates an example of battery voltage output states of a vehicle.

For example, assume that X, the driving session cut-off time, is 10 minutes, and Y, the idling threshold duration is 5 minutes. Assume that a car that had started driving on 12:00 AM, drove until 15:30, than stopped at the road side for 15 minutes with its engine operating and then for another 15 minutes with its engine off, before again driving from 16:00 till 18:00, during which it stopped for 7 minutes. In this example, which is illustrated in FIG. 3, two driving sessions are considered to exist. A first driving session is from 12:00 until 15:30 and a second driving session is from 16:00 till 18:00. In addition, there are two idling periods, one extending from 15:30 till 15:45 and the other from 17:00 till 17:07. However, there are differences between these two idling periods. In an embodiment, processing steps can distinguish between four types of idling periods:

First type—idling period completely outside a driving session. By this scenario, the driver started the vehicle engine and left it running for longer than the minimum idling threshold duration. Then he turned off the engine without moving the vehicle at all, and without triggering the start of a driving session. This type of idling period would not be associated with a driving session, but would be reported in the idling report.

Second type—idling period immediately prior to the beginning of a driving session. By this scenario, the driver started the vehicle engine, left it running for longer than an idling threshold duration, and then moved the vehicle before turning off the engine and thus began a driving session. In this case, the idling event is associated with the driving session that begins immediately following the end of the idling period.

Third type—idling period overlaps/immediately follows the end of a driving session. By this scenario, the driver stopped the vehicle, left the engine running for longer than an idling threshold duration value, and did not move the vehicle again before turning off the engine. Alternatively, the engine was left running for more than X minutes, the driving session cut-off time, meaning that the driving session ended while the idling period was ongoing, and the vehicle was moved after more than X minutes, thereby resulting in simultaneously ending the idling period and beginning a new driving session. In these situations, the idling period may be associated with the driving session that immediately precedes it. An example is the idling period from 15:30 until 15:45 in the example illustrated in FIG. 3.

Fourth type—idling period entirely within a driving session. By this scenario, the driver stopped the vehicle during a driving session and left the engine running for a period shorter than X minutes (where X is the value by which the termination of a driving session is defined, but longer than Y minutes, the idling threshold duration. Such an idling period is associated with the driving session in which it is embedded. An example is the idling period from 17:00 till 17:07 in the FIG. 3.

In an embodiment, any idling period of more than 30 seconds is considered avoidable, because when the driver expects to stop for more than 30 seconds, the engine is expected to be turned off. For purposes of analysing fuel efficiency, turning the engine on and off successively is considered to be equal to about 10 seconds of engine running.

In an embodiment, the general rule for associating idling events (that are not entirely within a single driving session) with respective driving sessions is that an idling event should be associated with the driving session that immediately precedes it. This general rule assumes that each driver should be responsible for turning off the engine before turning over the vehicle to a next driver or before starting a new driving session.

Figure 4:
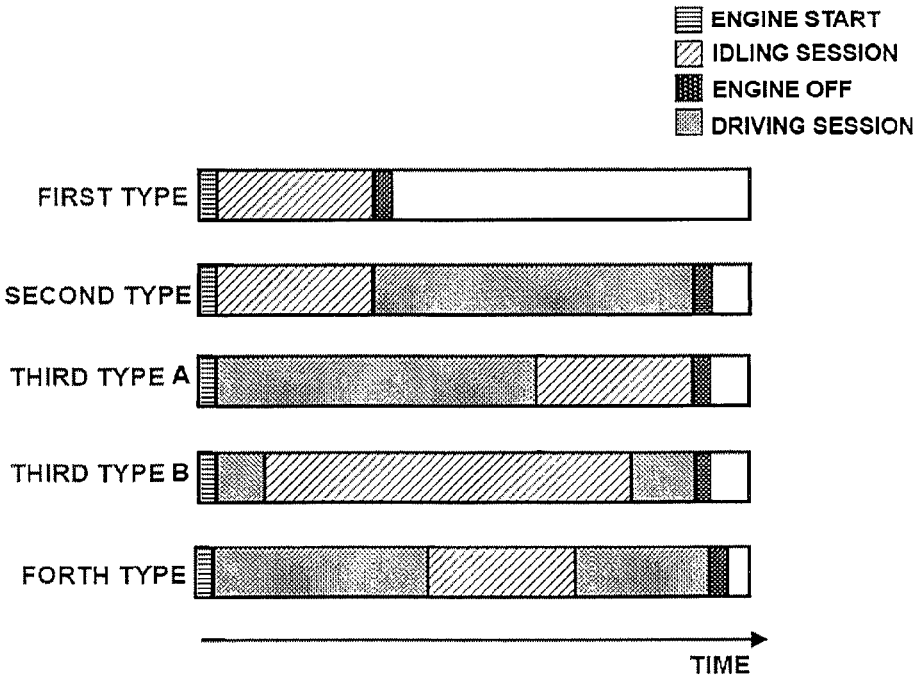
FIG. 4 illustrates four types of idling periods.

All the specified types of idling periods are demonstrated in FIG. 4.

A benefit of the process recognizing the type of idling is for developing an appropriate procedure in order to prevent each particular type of idling. For example, idling that is associated with warming up the vehicle usually occurs in parking lots and may be avoided by better educating drivers.

Once idling periods are associated with a driving session, they may also be associated with the respective driver, if information is available to identify the driver in the driving session. Associating a driving session with a particular driver may be performed using any available identification procedure.

Embodiments provide a simple yet effective way to evaluate idling performance for an individual vehicle or individual driver as well as for a fleet or sub-fleet. In an embodiment, evaluation is based on determining an idling rate, which is a fraction of the time during which the vehicle was idling, divided by the total time during which the engine was on.

In an embodiment, the durations of all idling period staking place during a specified time period are aggregated, and the sum is divided by the aggregated durations during which the engine was on within the same period of time. For example, if there are 3 idling periods of durations 6, 15, and 8 minutes (and assuming that the minimum idling threshold is 4 minutes) that occurred during a period at which the engine was on for 305 minutes, the idling rate would be:

$$(6+15+8)/305*100=9.5\%$$

Determining idling rate enables managers to focus on drivers and/or vehicles that need their highest attention. In an embodiment, processes allow categorisation of idling performance into green, yellow, and red levels. The definition of these levels (i.e., the idling rate thresholds for each level) may be customized to support idling performance goals of a particular vehicle fleet. For example, for one fleet, green level idling could be defined as an idling rate below 0.5%, yellow level idling as an idling rate between 0.5% and 1%, and red level idling as a rate of 1% or higher. The fleet manager may first focus on eliminating red level idling cases across the relevant drivers in his fleet and only then focus on moving drivers with yellow level idling performance into the green zone.

Ways of Reporting Retrieved Information

In an embodiment, idling periods are automatically associated with the particular vehicles that were idling. However, viewing idling event information per vehicle is not always sufficient. To effectively assess, manage, and eliminate unnecessary idling, managers may wish to assess which drivers are responsible to the idling session(s), and often, which driving courses are associated with excessive idling periods. In other words, if it is found that a large number of drivers tend to leave their vehicles in idle mode when stopping at a certain place (e.g. a certain lay-by area), then the manager can instruct the drivers to take other routes whenever possible.

In an embodiment, the information regarding the idling periods is associated with a specific driver or specific driving course or specific location. This information provides managers better insight into idling behaviour across the fleet and allows them to refer to details about specific idling periods or driving course with poor idling performance, when they need to coach drivers.

Figure 5:
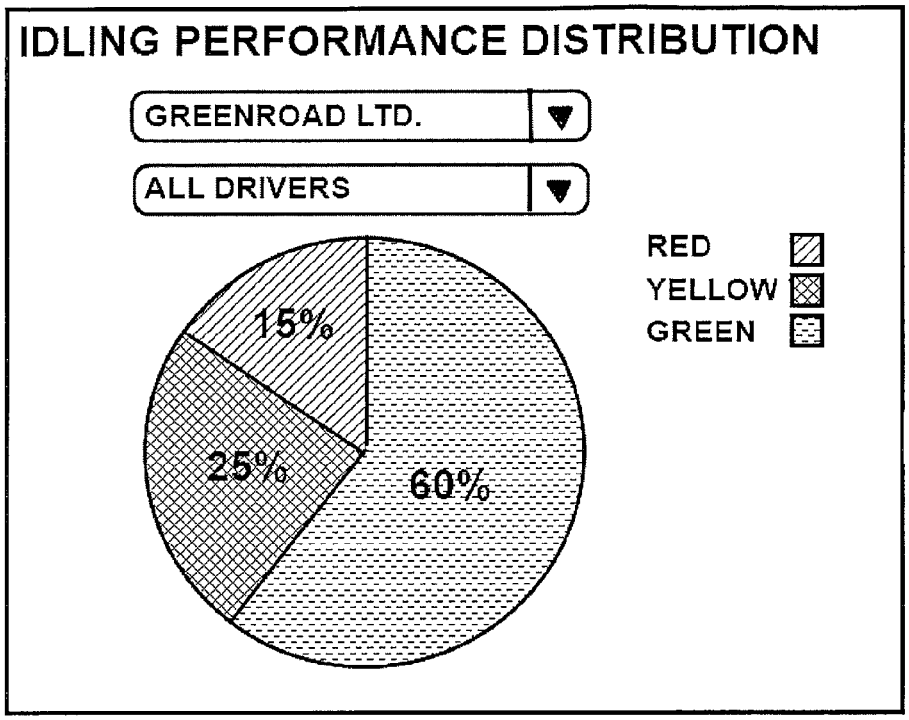
FIG. 5 demonstrates an example of presenting idling performance distribution to a user of the system.

In an embodiment, when fleet managers log in to the company web site, they may be able to instantly assess the idling performance of their fleet via an idling performance level dashboard presentation. An example is illustrated in FIG. 5. In an embodiment, fleet managers are able to drill down the presentation in order to view the performance of drivers or vehicles which are represented by the slice of the pie they click on. For example, clicking on the red slice will show idling performance for the red idlers.

Benefits

Embodiments provide for measuring idling duration in ways that overcome drawbacks of other approaches. For example, embodiments do not need a direct wire connection between a telematics device and the vehicle's ignition switch and do not need to use the ignition switch mechanism to determine if the engine is in an "on" or "off" position. A direct connection to the ignition switch is considered to constitute a violation of the vehicle warranty in some countries, and embodiments have the benefit of avoiding this issue. In other cases vehicles may not offer good locations where a connection to the ignition switch can be made. Still other vehicle models do not use a key switch, so that a direct connection cannot be made.

Embodiments also avoid problems involved in using data retrieved from an Engine Computer Module (ECM). To obtain ECM data a connection using a vehicle bus interface or protocol (e.g., CANbus, FMS) is required, but many vehicles manufactured before 1996 (or, in Europe, before 2001) do not have a standard port to the ECM. Using an ECM interface solely for detecting ignition status adds significantly to the cost of a system.

Embodiments also provide numerous benefits to vehicle fleet managers operating under widely varying environments. Embodiments provide a flexible method to meet such varying needs in a novel and efficient manner.

Implementation Mechanisms—Example hardware and Computer-Readable Medium

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 7:
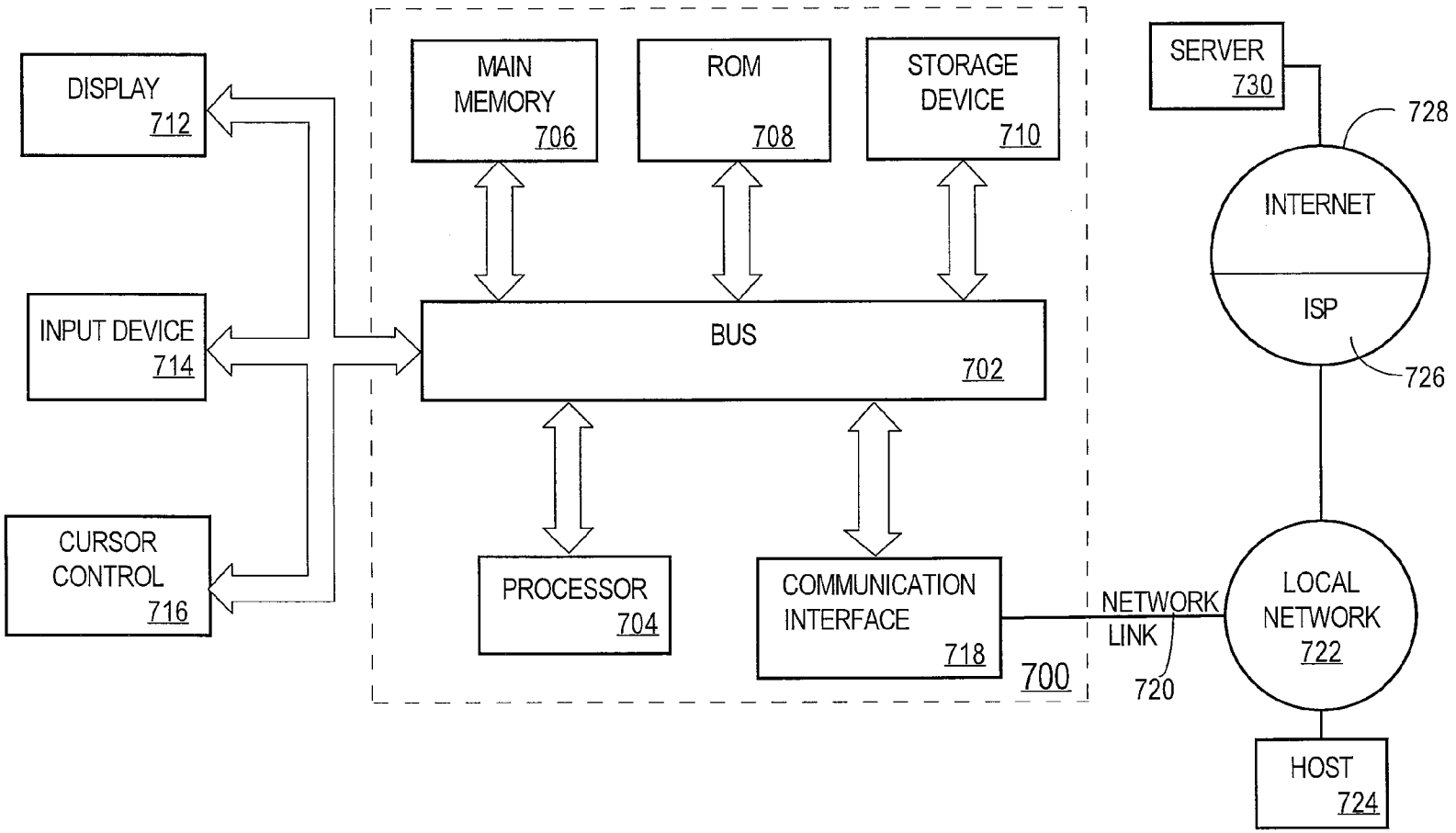
FIG. 7 illustrates a computer system with which an implementation may be used.

For example, FIG. 7 is a block diagram that illustrates a computer system 700 upon which an embodiment of the invention may be implemented. Computer system 700 includes a bus 702 or other communication mechanism for communicating information, and a hardware processor 704 coupled with bus 702 for processing information. Hardware processor 704 may be, for example, a general purpose microprocessor.

Computer system 700 also includes a main memory 706, such as a random access memory (RAM) or other dynamic storage device, coupled to bus 702 for storing information and instructions to be executed by processor 704. Main memory 706 also may be used for storing temporary variables or other intermediate information during execution of instructions to be executed by processor 704. Such instructions, when stored in non-transitory storage media accessible to processor 704, render computer system 700 into a special-purpose machine that is customized to perform the operations specified in the instructions.

Computer system 700 further includes a read only memory (ROM) 708 or other static storage device coupled to bus 702 for storing static information and instructions for processor 704. A storage device 710, such as a magnetic disk or optical disk, is provided and coupled to bus 702 for storing information and instructions.

Computer system 700 may be coupled via bus 702 to a display 712, such as a cathode ray tube (CRT), for displaying information to a computer user. An input device 714, including alphanumeric and other keys, is coupled to bus 702 for communicating information and command selections to processor 704. Another type of user input device is cursor control 716, such as a mouse, a trackball, or cursor direction keys for communicating direction information and command selections to processor 704 and for controlling cursor movement on display 712. This input device typically has two degrees of freedom in two axes, a first axis (e.g., x) and a second axis (e.g., y), that allows the device to specify positions in a plane.

Computer system 700 may implement the techniques described herein using customized hard-wired logic, one or more ASICs or FPGAs, firmware and/or program logic which in combination with the computer system causes or programs computer system 700 to be a special-purpose machine. According to one embodiment, the techniques herein are performed by computer system 700 in response to processor 704 executing one or more sequences of one or more instructions contained in main memory 706. Such instructions may be read into main memory 706 from another storage medium, such as storage device 710. Execution of the sequences of instructions contained in main memory 706 causes processor 704 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage device 710. Volatile media includes dynamic memory, such as main memory 706. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 702. Transmission media can also take the form of acoustic or light waves, such as those generated during radio-wave and infra-red data communications.

Various forms of media may be involved in carrying one or more sequences of one or more instructions to processor 704 for execution. For example, the instructions may initially be carried on a magnetic disk or solid state drive of a remote computer. The remote computer can load the instructions into its dynamic memory and send the instructions over a telephone line using a modem. A modem local to computer system 700 can receive the data on the telephone line and use an infra-red transmitter to convert the data to an infra-red signal. An infra-red detector can receive the data carried in the infra-red signal and appropriate circuitry can place the data on bus 702. Bus 702 carries the data to main memory 706, from which processor 704 retrieves and executes the instructions. The instructions received by main memory 706 may optionally be stored on storage device 710 either before or after execution by processor 704.

Computer system 700 also includes a communication interface 718 coupled to bus 702. Communication interface 718 provides a two-way data communication coupling to a network link 720 that is connected to a local network 722. For example, communication interface 718 may be an integrated services digital network (ISDN) card, cable modem, satellite modem, or a modem to provide a data communication connection to a corresponding type of telephone line. As another example, communication interface 718 may be a local area network (LAN) card to provide a data communication connection to a compatible LAN. Wireless links may also be implemented. In any such implementation, communication interface 718 sends and receives electrical, electromagnetic or optical signals that carry digital data streams representing various types of information.

Network link 720 typically provides data communication through one or more networks to other data devices. For example, network link 720 may provide a connection through local network 722 to a host computer 724 or to data equipment operated by an Internet Service Provider (ISP) 726. ISP 726 in turn provides data communication services through the world wide packet data communication network now commonly referred to as the "Internet" 728. Local network 722 and Internet 728 both use electrical, electromagnetic or optical signals that carry digital data streams. The signals through the various networks and the signals on network link 720 and through communication interface 718, which carry the digital data to and from computer system 700, are example forms of transmission media.

Computer system 700 can send messages and receive data, including program code, through the network(s), network link 720 and communication interface 718. In the Internet example, a server 730 might transmit a requested code for an application program through Internet 728, ISP 726, local network 722 and communication interface 718.

The received code may be executed by processor 704 as it is received, and/or stored in storage device 710, or other non-volatile storage for later execution.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

It is to be understood that the above description only includes some embodiments of the invention and serves for its illustration. Numerous other ways of carrying out the methods provided by the present invention may be devised by a person skilled in the art without departing from the scope of the invention, and are thus encompassed by the present invention.

What is claimed is:

1. A data processing system, comprising:

a first sensor adapted to provide indications relating to a vehicle's engine operational mode;

a second sensor adapted to provide indications related tote vehicle movement;

a processor adapted to identify whether the vehicle's engine has undergone one or more idling periods, based on at least: one indication that relates to the vehicle's engine operational mode and at least one indication that relates to the vehicle movement;

wherein the indication that relates to the vehicle's engine operational mode is derived from at least one of: an engine computer module (ECM), a vehicle ignition switch, or a measurement of the voltage output from the vehicle; and wherein the processor is further configured to classify one or more idling periods based upon a driving session occurring before or after the idling periods and to distinguish between four types of idling periods as follows:

a first type of idling period defined as an idling period completely outside the driving session, wherein a driver started the vehicle's engine, left it running for longer than an idling threshold duration, and turned off the engine without moving the vehicle at all, and without triggering start of another driving session, wherein the first type of idling period is not associated with the driving session, but is reported in an idling report;

a second type of idling period defined as an idling period immediately prior to a beginning of a driving session, wherein the driver started the vehicle's engine, left it running for longer than an idling threshold duration, and then moved the vehicle before turning off the engine and thus began a driving session, wherein the second type of idling period is associated with the driving session that begins immediately following the end of the idling period;

a third type of idling period defined as an idling period that overlaps/immediately follows an end of the driving session, wherein the driver stopped the vehicle, left the engine running for longer than an idling threshold duration value, and did not move the vehicle again before turning off the engine, wherein the third type of idling period is associated with the driving session that immediately precedes it; and a fourth type of idling period defined as an idling period entirely within a driving session, wherein the driver stopped the vehicle during a driving session and left the engine running for a period shorter than a time duration value by which the termination of a driving session is defined, but longer than the idling threshold duration, wherein the fourth type of idling period is associated with the driving session in which it is embedded.

2. The system according to claim 1, wherein the first sensor is configured to obtain a vehicle battery voltage value and wherein the processor is configured to detect one or more changes in the vehicle's operational status based on the vehicle battery voltage value.

3. The system according to claim 2, wherein the processor is configured to detect one or more voltage signatures in the vehicle's battery voltage output, each of the signatures associated with a different operational mode of an engine of the vehicle.

4. The system according to claim 2, wherein the processor is further configured to compensate for variations in the detected voltage signatures for various types of vehicles.

5. The system according to claim 1, wherein the second sensor is configured to obtain acceleration data which relate to the vehicle' s movement, and wherein the processor is configured to detect a change in the vehicle's operational status based on one or more acceleration changes which the vehicle has undergone.

6. The system according to claim 1, further comprising means of displaying indications to a driver which relate to the idling periods.

7. A method comprising:

obtaining a threshold parameter that identifies an idling period;

obtaining at least one first indication of an operational mode of a vehicle's engine from at least one of: an engine computer module (ECM), a vehicle ignition switch, or measurement of the vehicle's voltage output;

obtaining at least one second indication of movement of the vehicle;

analyzing the at least one first indication and the at least one second indication and, based on information retrieved from said at least one first indication and said the at least one second indication, identifying, based on the threshold parameter, one or more idling periods which the vehicle's engine has undergone;

wherein the method is performed by one or more computing devices; and classifying one or more idling periods based upon a driving session occurring before or after the idling periods and distinguishing between four types of idling periods as follows:

a first type of idling period defined as an idling period completely outside the driving session, wherein a driver started the vehicle's engine, left it running for longer than an idling threshold duration, and turned off the engine without moving the vehicle at all, and without triggering start of another driving session, wherein the first type of idling period is not associated with the driving session, but is reported in an idling report;

a second type of idling period defined as an idling period immediately prior to a beginning of a driving session, wherein the driver started the vehicle's engine, left it running for longer than an idling threshold duration, and then moved the vehicle before turning off the engine and thus began a driving session, wherein the second type of idling period is associated with the driving session that begins immediately following the end of the idling period:

a third type of idling period defined as an idling period that overlaps/immediately follows an end of the driving session, wherein the driver stopped the vehicle, left the engine running for longer than an idling threshold duration value, and did not move the vehicle again before turning off the engine, wherein the third type of idling period is associated with the driving session that immediately precedes it; and a fourth type of idling period defined as an idling period entirely within a driving session, wherein the driver stopped the vehicle during a driving session and left the engine running for a period shorter than a time duration value by which the termination of a driving session is defined, but longer than the idling threshold duration, wherein the fourth type of idling period is associated with the driving session in which it is embedded.

8. The method according to claim 7, wherein the retrieved information is obtained by detecting a voltage output value of a battery of the vehicle.

9. The method according to claim 8, further comprising detecting one or more voltage signatures in the voltage output value, each of the signatures associated with a different operational mode of an engine of the vehicle.

10. The method according to claim 7, further comprising classifying one or more of the idling periods based upon driving sessions occurring before or after the idling periods.

11. The method according to claim 7, further comprising calculating changes in the vehicle's acceleration, and applying one or more of the calculated acceleration changes to detect a change in the vehicle's operational status.

12. The method according to claim 7, further comprising transmitting the first indication and the second indication towards a server computer, to enable identifying unnecessary idling periods at the server computer.

13. A non-transitory computer-readable storage media storing one or more sequences of instructions which when executed cause one or more processors to perform:

detecting a change in an operational mode of a vehicle's engine, based on one or more first input signals from a first sensor, the one or more first input signals derived from at least one of: an engine computer module (ECM), a vehicle ignition switch, or measurement of the vehicle's voltage output;

detecting a change in movement of the motor vehicle based on one or more second input signals from a second sensor;

identifying one or more idling periods which the motor vehicle has undergone, based on the first input signals and the second input signals;

storing data representing the one or more idling periods; and classifying one or more idling periods based upon a driving session occurring before or after the idling periods and distinguishing between four types of idling periods as follows:

a first type of idling period defined as an idling period completely outside the driving session, wherein a driver started the vehicle's engine, left it running for longer than an idling threshold duration, and turned off the engine without moving the vehicle at all, and without triggering start of another driving session, wherein the first type of idling period is not associated with the driving session, but is reported in an idling report;

a second type of idling period defined as an idling period immediately prior to a beginning of a driving session, wherein the driver started the vehicle's engine, left it running for longer than an idling threshold duration, and then moved the vehicle before turning off the engine and thus began a driving session, wherein the second type of idling period is associated with the driving session that begins immediately following the end of the idling period;

a third type of idling period defined as an idling period that overlaps/immediately follows an end of the driving session, wherein the driver stopped the vehicle, left the engine running for longer than an idling threshold duration value, and did not move the vehicle again before turning off the engine, wherein the third type of idling period is associated with the driving session that immediately precedes it; and a fourth type of idling period defined as an idling period entirely within a driving session, wherein the driver stopped the vehicle during a driving session and left the engine running tor a period shorter than a time duration value by which the termination of a driving session is defined, but longer than the idling threshold duration, wherein the fourth type of idling period is associated with the driving session in which it is embedded.

14. The storage media of claim 13, further comprising instructions which when executed cause obtaining a voltage value from a battery of the motor vehicle.

15. The storage media of claim 14, further comprising instructions which when executed cause detecting one or more voltage signatures in the voltage value, wherein each of the signatures is associated with a different operational mode of an engine of the motor vehicle.

16. The storage media of claim 14, further comprising instructions which when executed cause compensating for variations in the detected voltage signatures for various types of vehicles.

17. The storage media of claim 14, further comprising instructions which when executed cause identifying the one or more idling periods based upon data describing one or more driving sessions occurring before or after the idling periods.

18. The storage media of claim 14 further comprising instructions which when executed cause displaying indications to a driver which relate to the idling periods.

19. The storage media of claim 14, further comprising instructions which when executed cause storing driver identification data that associates one or more of the idling periods to one or more particular drivers.

20. The storage media of claim 14, further comprising instructions which when executed cause storing driver identification data that associates one or more of the idling periods to one or more particular motor vehicles.

21. A data processing system, comprising:

a first sensor adapted to provide indications relating to a vehicle's fuel based engine operational mode;

a second sensor adapted to provide indications related to the vehicle movement;

a processor adapted to identify one or more vehicle idling periods, based on at least: one indication that relates to the vehicle's engine operational mode and at least one indication that relates to the vehicle movement;

wherein the indication that relates to the vehicle's engine operational mode is derived from at least one of: an engine computer module (ECM), a vehicle ignition switch, or a measurement of the voltage output from the vehicle; and wherein the processor is further configured to classify one or more idling periods based upon a driving session occurring before or after the idling periods and to distinguish between four types of idling periods as follows:

a first type of idling period defined as an idling period completely outside the driving session, wherein a driver started the vehicle's engine, left it running for longer than an idling threshold duration, and turned off the engine without moving the vehicle at all, and without triggering start of another driving session, wherein the first type of idling period is not associated with the driving session, but is reported in an idling report;

a second type of idling period defined as an idling period immediately prior to a running for longer than an idling threshold duration, and then moved the vehicle before turning off the engine and thus began a driving session, wherein the second type of idling period is associated with the driving session that begins immediately following the end of the idling period;

a third type of idling period defined as an idling period that overlaps/immediately follows an end of the driving session, wherein the driver stopped the vehicle, left the engine running for longer than an idling threshold duration value, and did not move the vehicle again before turning off the engine, wherein the third type of idling period is associated with the driving session that immediately precedes it; and a fourth type of idling period defined as an idling period entirely within a driving session, wherein the driver stopped the vehicle during a driving session and left the engine running for a period shorter than a time duration value by which the termination of a driving session is defined, but longer than the idling threshold duration, wherein the fourth type of idling period is associated with the driving session in which it is embedded.

* * * * *